United States Patent [19]

Markert

[11] 4,098,404

[45] Jul. 4, 1978

[54] VACUUM PACKAGE WITH FLEXIBLE END

[75] Inventor: Herman Rupert Markert, Hartsville, S.C.

[73] Assignee: Sonoco Products Company, Hartsville, S.C.

[21] Appl. No.: 544,500

[22] Filed: Jan. 27, 1975

Related U.S. Application Data

[63] Continuation-in-part of Ser. No. 335,393, Feb. 23, 1973, abandoned.

[51] Int. Cl.[2] ..... B65D 3/10; B65D 3/22

[52] U.S. Cl. ..... 206/525; 206/524.8; 220/66; 220/68; 229/5.5; 426/124; 426/398; 426/404

[58] Field of Search ..... 426/131, 124, 126, 398, 426/404; 220/66, 68, 70; 229/5.5, 3.1; 206/525, 808

[56] References Cited

U.S. PATENT DOCUMENTS

| | | | |
|---|---|---|---|
| 2,735,604 | 2/1956 | Zerlin | 229/3.1 |
| 3,353,325 | 11/1967 | Jensen et al. | 53/22 |

FOREIGN PATENT DOCUMENTS

| | | | |
|---|---|---|---|
| 1,043,649 | 9/1966 | United Kingdom | 220/68 |

*Primary Examiner*—Stephen P. Garbe
*Attorney, Agent, or Firm*—Dennison, Dennison, Meserole & Pollack

[57] ABSTRACT

A vacuum package comprising a composite container of multi-ply paper and foil construction having the contents thereof retained in a vacuum environment, a container rigidifying end cap sealing one end thereof and a flexible tearable membrane sealing the other end with a plastic overcap at the membrane end, said membrane being inwardly flexed by atmospheric pressure against the container contents for a compaction thereof and a corresponding rigidification of the vacuum pack.

5 Claims, 5 Drawing Figures

12
20
28
VACUUM CHAMBER
40
26
42
14
10
30
38

VACUUM PACKAGE WITH FLEXIBLE END

This is a continuation-in-part of application Ser. No. 335,393, filed Feb. 23, 1973 now abandoned for VACUUM PACK CAN WITH FLEXIBLE END AND METHOD OF PRODUCING SAME.

It has been known to utilize a membrane in various drums or containers when shipping goods, such as liquids, in order to prevent sloshing or potentially destructive movement of the goods contained within the container as it moved about. It has also been known to utilize a diaphragm for separation of various materials within containers. Further, use of membranes of a transparent nature are known in order to better display the goods within the container.

Each of the above constructions has a specific advantage, but fails to suggest utilization of a membrane in providing a composite container capable of receiving goods such as granular materials, coffee, sugar, powdered drink concentrate, and so forth, in a manner to provide a strong or internally strengthened unit. The prior art constructions are primarily the solid, heavy wall type container which has considerable inherent structural strength and integrity. These constructions fail to utilize the economical aspects of a composite container made from multiple plies of paper and other materials or impermeable characteristics in that such composite containers have heretofore had the disadvantage of being of minimal strength. Because of this lack of strength, these containers cannot be stacked and shipped or stored in the most economical or advantageous manner.

Another disadvantage of the composite containers heretofor used is in regard to what is commonly referred to as easy-open ends used thereon. These easy-open ends are extremely sharp and, when opened, provide dangerous exposed edges to the customer when removing the goods.

The disadvantages heretofor associated with composite container packs or packages have been effectively and uniquely overcome by a unique package construction and method of packing. More specifically, a flexible force or load transferring membrane is utilized to seal one end of a container, the other end of which is sealed by a conventional or standard metal cap. Both the packing of the container and the sealing thereof is effected under reduced pressure or vacuum conditions whereby, upon a removal of the package from the low pressure conditions, atmospheric pressure acting on the outer surface of the end closing membrane, which is of course air impermeable, will produce an inward distortion of the membrane and the compacting of the goods or product within the container against the inner surfaces of the container and end closures. In this manner, a tight package is provided and substantial additional rigidity and strength, beyond that normally associated with a composite or layered container, is achieved. The package is completed by the provision of a protective overcap over the membrane, the overcap also providing a smooth stacking surface. It is contemplated that the membrane be of a readily tearable material such as aluminum foil. In this manner, the membrane can be easily removed for a dispensing of the contents with a resealing of the package being easily affected by the slip-on overcap. The overcap can, if deemed desirable, have an aperture or opening therethrough to allow exposure of the outer surface of the membrane to atmospheric pressure even should the overcap be applied in the vacuum environment.

The invention may best be understood by reference to the following description taken in conjunction with the accompanying drawings wherein like numerals refer to like elements and in which.

Figure 1:
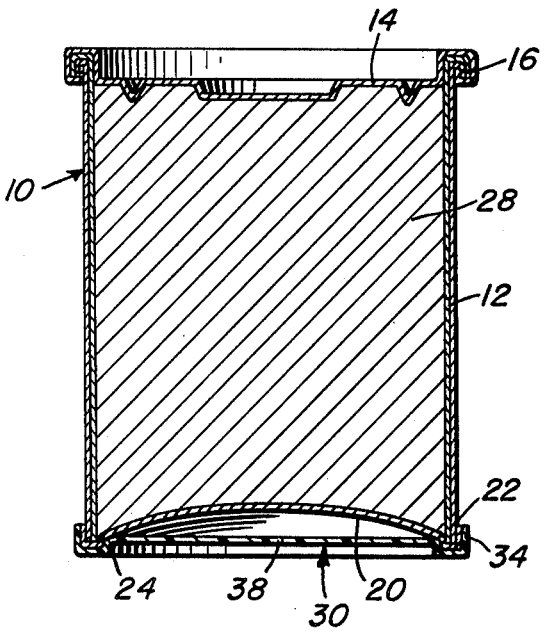
FIG. 1 shows, in cross-section, a filled container embodying the instant invention.

Referring now more specifically to the drawings, and particularly to the completed package of FIG. 1, container 10 is shown to include a multi-ply air impermeable body 12. Body 12 is of conventional construction for a composite container in that there are multiple plies of paper and foil as necessary for the wall construction, normally with an inner impermeable liner.

One end of container 10 is sealed with a conventional or standard metal end 14. This metal end 14 may be of any given configuration and is generally applied in a double seam sealing arrangement as will be noted in FIG. 1. In order to accomplish the sealing of the metal end 14 in an appropriate manner, a double crimp seal 16 is preferably used which insures the integrity of the interior of container 10. The double crimp seal 16 is the result of attaching standard metal end 14 at the flared end 18 of can body 12.

A flexible air impervious aluminum foil end or membrane 20 is secured and sealed at the opposite end 22 of container 10 from flared end 18 to which standard metal end 14 is applied. Membrane 20 may be attached and sealed in any given fashion, as at 24, to opposite end 22 of container body 12 as by any conventional material such as a hot melt adhesive or other themoplastic material which is generally applied to the inner liner of the body 12. In the completed package, the sealed container 10 maintains the contents thereof under reduced pressure or in a vacuum environment.

Plastic overcap 30, of a conventional construction and colored, translucent or transparent as desired, has an inwardly extending peripheral flange 34 so designed as to insure a tight fit and seal between overcap 30 and the side wall 12 of container 10. As will be explained hereinafter, overcap 30 may have opening 38 for equalization of pressure between membrane 20 and the atmosphere.

Figure 2:
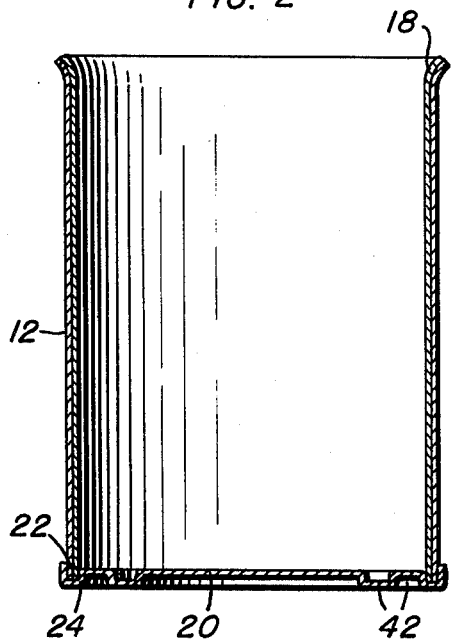
FIG. 2 shows the container body with one end sealed prior to filling and as normally supplied to a packer.
Figure 5:
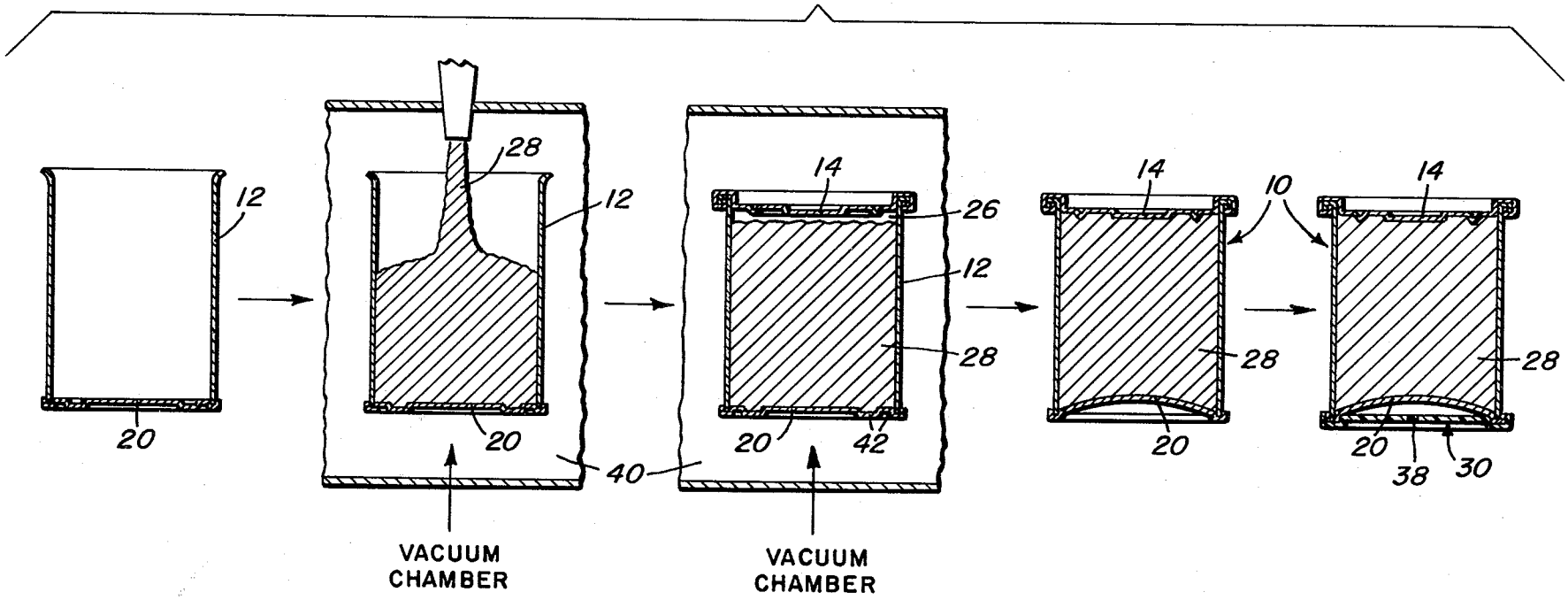
FIG. 5 schematically illustrates the steps in filling the container and forming the package.

In the filling or production operation, as schematically shown in FIG. 5, the container body is supplied to the packager of the goods with the flexible air impermeable membrane 20 sealed across one end 22 thereof. This basic assembly is shown in FIG. 2.

Figure 3:
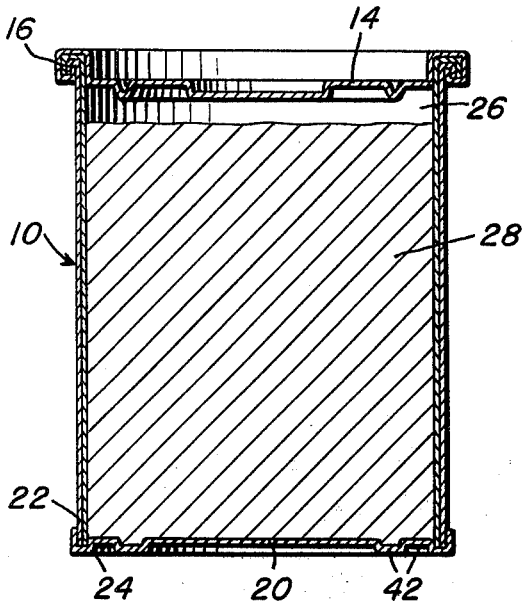
FIG. 3 shows the container after the product has been placed therein and the standard metal end applied within the vacuum chamber.
Figure 4:
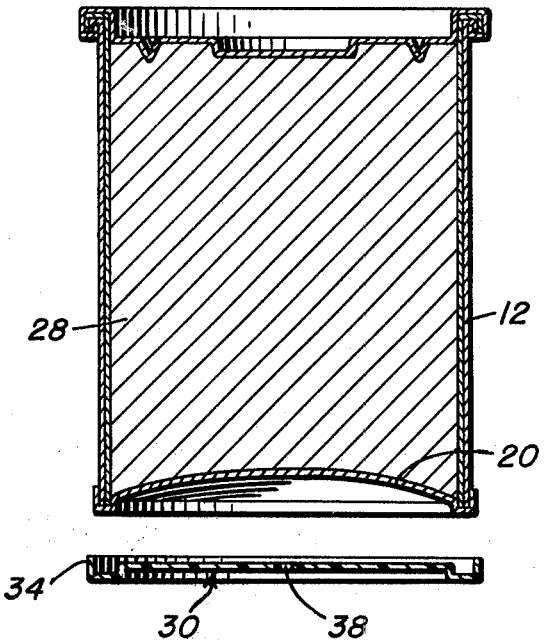
FIG. 4 shows the composite container upon removal from the vacuum sealing chamber with the overcap spaced therefrom.

The container in this arrangement is then run through a conventional filling operation which occurs entirely within a vacuum type chamber 40 such that goods 28 are deposited in the container and standard metal end 14 is applied. It will be noted that while container 10 remains in the vacuum sealing chamber a void or pocket 26 exists between end 14 and the goods 28 and the membrane 20 is relaxed. Incidentally, the relaxed membrane 20 may include corrugations or the like 42 as suggested in FIGS. 2 and 3 to facilitate the subsequent expansion or flexing thereof.

Vacuum filled and sealed container 10 is then removed from the vacuum chamber and, due to the atmospheric pressure exerted on membrane 20 and the pressure differential achieved by the vaccum environment within the sealed container, the membrane is dislocated and tensioned inwardly in a direction along the longitudinal axis of container 10. This inward pressure induced flexing of membrane 20 firmly compacts and conforms the goods 28 against the inner surfaces of the end 14 and body 12. Plastic overcap 30 is then applied to form a flat stacking end and insure protection of the tearable membrane 20 during storage and display for sale. It is to be noted that overcap 30 may have an opening 38 and thus be applied in the vacuum chamber as opening 38 permits introduction of atmospheric pressure to membrane 20 once the package is removed from the vacuum chamber 40. When the goods are to be consumed, it is merely necessary to remove the plastic overcap, tear out membrane 20 and remove the same. This construction avoids any sharp edges whih might cause injury and permits overcap 30 to reseal any unused contents in the container 10.

While, as discussed in detail supra, the container body 12 will normally be introduced into the vacuum chamber 40 with the flexible membrane 20 secured and sealed across one end thereof and the standard cap 14 applied subsequent to a filling of the container, in some circumstances, it may be desirable to first apply the standard end cap 14, then fill the container body with the goods being introduced against end cap 14, and finally applying the flexible membrane 20. As will be appreciated, in this arrangement, the filling of the container and the subsequent application of the flexible membrane 20 will also of course occur within the vacuum chamber.

Another variation of the filling procedure which, while not specifically illustrated will be readily apparent from the afore described FIG. 5 procedure, involves an initial filling of the container outside of the vacuum environment. More particularly, the container, with one end of the body 12 sealed either by the deformable membrane 20 or the cap 14, is filled. Next, the closure for the second end is loosely engaged with the second end of the body 12 in a manner so as to specifically not seal the interior thereof. The container is then placed into the vacuum environment for an evacuation of the interior of the container 10. While still in the vacuum environment, the closure for the second end is firmly affixed and sealed to the container body 12 to complete the container and define a sealed vacuum package. The container is then removed from the vacuum environment.

From the foregoing, it will be appreciated that a highly unique package and method of packing has been defined which enables the use of economical composite containers in circumstances not heretofor thought possible because of the inherent wall weakness of such containers. This is achieved basically through the unique utilization of a pressure applying membrane as an end closure in conjunction with the provision of a vacuum or low pressure condition within the package through the filling of the package and the sealing of the package in a low pressure or vacuum environment.

The foregoing is considered illustrative of the principles of the invention. Since modifications and changes may readily occur to those skilled in the art, it is not desired to limit the invention to the exact construction and operation shown and described. Accordingly, all suitable modifications and equivalence may be resorted to, falling within the scope of the invention as claimed.

What is claimed is:

1. An air impermeable vacuum package comprising a body having opposed ends, said body being of composite construction and having at least one air impermeable liner, an air impermeable end cap sealing one end of the body, an air impermeable force transmitting membrane sealed to the impermeable liner and sealing the other end of the body, said membrane being readily deformable relative to said body, a compactable product sealed within the body by the end cap and the membrane, a reduced pressure environment within the package sufficient to effect a pressure differential relative to external atmospheric pressure such that said membrane is inwardly deformed into force transmitting compacting engagement with the product, said product being compacted by said pressure deformed force transmitting membrane against the inner surfaces of the body and end cap and internally rigidifying and strengthening the package.

2. The package of claim 1 including a protective overcap overlying said membrane.

3. The package of claim 3 wherein said overcap has an air passing hole defined therethrough.

4. The package of claim 1 wherein said membrane, prior to inward deformation, is at least partially corrugated.

5. The package of claim 1 wherein said membrane is flexible.

* * * * *